US006572217B2

(12) United States Patent
Kikuchi et al.

(10) Patent No.: US 6,572,217 B2
(45) Date of Patent: Jun. 3, 2003

(54) INK JET PRINTER HEAD

(75) Inventors: Takashi Kikuchi, Numazu (JP); Isao Suzuki, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/888,514

(22) Filed: Jun. 26, 2001

(65) Prior Publication Data

US 2002/0001017 A1 Jan. 3, 2002

(30) Foreign Application Priority Data

Jun. 27, 2000 (JP) ..... 2000-191999
Mar. 5, 2001 (JP) ..... 2001-060257

(51) Int. Cl.[7] ..... B41J 2/135
(52) U.S. Cl. ..... 347/47
(58) Field of Search ..... 347/20, 45, 40, 347/46, 44, 47

(56) References Cited

U.S. PATENT DOCUMENTS 5,493,320 A * 2/1996 Sandback, Jr. et al. ..... 347/47
6,074,040 A * 6/2000 Usui et al. ..... 347/45
6,341,836 B1 * 1/2002 Koike et al. ..... 347/20
6,423,476 B1 * 7/2002 Yun ..... 430/320

FOREIGN PATENT DOCUMENTS

| | | |
|---|---|---|
| EP | 0 564 102 | 10/1993 |
| EP | 0 703 082 | 3/1996 |
| EP | 0 960 733 | 12/1999 |
| FR | 2 747 960 | 10/1997 |
| JP | 2-88247 | 3/1990 |
| JP | 5-201000 | 8/1993 |
| JP | 5-201028 | 8/1993 |
| JP | 11-207979 | 8/1999 |

* cited by examiner

*Primary Examiner*—Anh T. N. Vo
(74) *Attorney, Agent, or Firm*—Oblon, Spivak, McClelland, Maier & Neustadt, P.C.

(57) ABSTRACT

The present invention provides a plate-like protect member at a front surface of an ink jet printer head having an orifice which is capable of jetting ink. The protect member provides a step around the orifice having an outer portion higher than an inner portion. The protect member also provides an ink repellency layer on an outer portion of the step. Thus, the ink jet printer head of the present invention can prevent the jetted ink from the orifice to creep up toward back of the ink jet printer head which is reverse direction to the ink jetting direction.

17 Claims, 8 Drawing Sheets

INK JET PRINTER HEAD

CROSS REFERENCE TO RELATED APPLICATIONS

The present application is based on Japanese Priority Documents Patent Application 2000-191999 filed on Jun. 27, 2000, and Patent Application 2001-060257 filed on Mar. 5, 2001, the content of which is incorporated herein by reference.

BACKGROUND OF THE INVENTION

1. Field of the Invention

The present invention relates to an ink jet printer head for using an ink jet printer which forms image by jetting ink drops. More specifically, the present invention relates to a technique for preventing jetted ink to attach a front surface of the ink jet printer head and creep up toward back of the ink jet printer head.

2. Discussion of the Background

FIG. 8 is a perspective view of a conventional ink jet printer head unit. As shown in FIG. 8, an ink jet printer head 1 and its driving circuit 3 are attached on a base plate 2 in the ink jet printer head unit 11. The ink jet printer head 11 provides an orifice plate 4 on a front end thereof. The orifice plate 4 provides a plurality of orifices 5, which operates an ink nozzle for jetting ink, in certain interval. A plurality of orifices 5 faces to an ink chamber for forming a pressure-generating chamber.

The ink jet printer head 1 provides a pair of ink supply pipes 6 for supplying ink to the ink chamber on certain portions of a lid 7 of the ink jet printer head 1. The driving circuit 3 equips with a driving IC 8 for driving actuators (not shown) provided in the ink chamber so as to jet the ink from the orifice 5. 9 identifies a connecting cable for connect the ink jet printer head 1 to a controller (not shown).

The conventional ink jet printer head has a drawback that the jetted ink from the orifice attaches to a front surface of the ink jet printer in jetting operation, so that the attached ink creeps up toward a back of the ink jet printer head. Thus, there is possibility that the ink crept up to the back of the ink jet printer head erodes away the driving circuit having the driving IC or the like.

SUMMARY OF THE INVENTION

Accordingly, an object of the present invention is to prevent jetted ink from a plurality ink nozzles of an ink jet printer head to creep up toward a back of the ink jet printer head.

Another object of the present invention is to obtain strong effect for preventing the jetted ink from the ink nozzles of the ink jet printer head to creep up toward a back of the ink jet printer head.

A further object of the present invention is to keep the effect for preventing the jetted ink from the ink nozzles of the ink jet printer head to creep up toward a back of the ink jet printer head.

A further object of the present invention is to protect a front surface of the ink jet printer disposing the ink nozzles from scrape, breakage or the like when the wiping operation or the like was executed.

Further object of the present invention is to prevent the leaked ink from a slit between the front surface of the ink jet printer and a protect member to creep up toward a back of the ink jet printer head.

A further object of the present invention is to prevent an adhesive adhering the front surface of the ink jet printer and the protect member flowing out.

These and further object of the present invention are achieved by the novel ink jet printer head of the present invention.

According to the novel ink jet printer head of the present invention comprises an ink chamber for storing an ink, a plurality of ink nozzles arrayed at a front surface of the ink jet printer head to connect to the ink chamber so as to contribute jetting the ink, and a creep preventing structure provided adjacent to the ink nozzles for preventing the jetted ink from the ink nozzle to creep up toward a back of the ink jet printer head which is reverse direction to the ink jetting direction.

Another aspect of the novel ink jet printer head of the present invention comprises an ink chamber for storing ink, a plurality of ink nozzles arrayed at a front surface of the ink jet printer head to connect to the ink chamber so as to contribute jetting the ink, a protect member provided on the front surface of the ink jet printer head to cause at least both sides of the ink nozzle array higher than an ink nozzle arranging surface so as to protect the ink nozzle arranging surface, and a groove provided around the ink nozzle array at a front surface of the protect member.

Another aspect of the novel ink jet printer head of the present invention comprises an ink chamber for storing ink, a plurality of ink nozzles arrayed at a front surface of the ink jet printer head to connect to the ink chamber so as to contribute jetting the ink, a protect member provided on the front surface of the ink jet printer head to cause at least both sides of the ink nozzle array higher than an ink nozzle arranging surface so as to protect the ink nozzle arranging surface, and a step provided around the ink nozzle array at a front surface of the protect member having an outer portion higher than an inner portion.

Another aspect of the novel ink jet printer head of the present invention comprises an ink chamber for storing ink, a plurality of ink nozzles arrayed at a front surface of the ink jet printer head to connect to the ink chamber so as to contribute jetting the ink, a protect member provided on the front surface of the ink jet printer head to cause at least both sides of the ink nozzle array higher than an ink nozzle arranging surface so as to protect the ink nozzle arranging surface, and an attachment restraint member formed at a front surface of the protect member by causing at least part of the front surface of the protect member ink repellent so as to retrain the ink attaching to the front surface of the ink jet printer head.

Another aspect of the novel ink jet printer head of the present invention comprises an ink chamber for storing ink, a plurality of ink nozzles arrayed at a front surface of the ink jet printer head to connect to the ink chamber so as to contribute jetting the ink, a protect member provided on the front surface of the ink jet printer head to cause at least both sides of the ink nozzle array higher than an ink nozzle arranging surface so as to protect the ink nozzle arranging surface, and a move restraint member formed as a shape of the protect member, which is tapered toward the front end of the ink jet printer head, so as to prevent the attached ink on the front surface of the ink jet printer head to move toward the back of the ink jet printer head.

The novel ink jet printer head of the present invention can prevent the jetted ink from the ink nozzle to creep up toward back of the ink jet printer head.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A first embodiment of the present invention is now explained with reference to FIGS. 1(A), (B) and 2(A), (B).

Figure 1A:
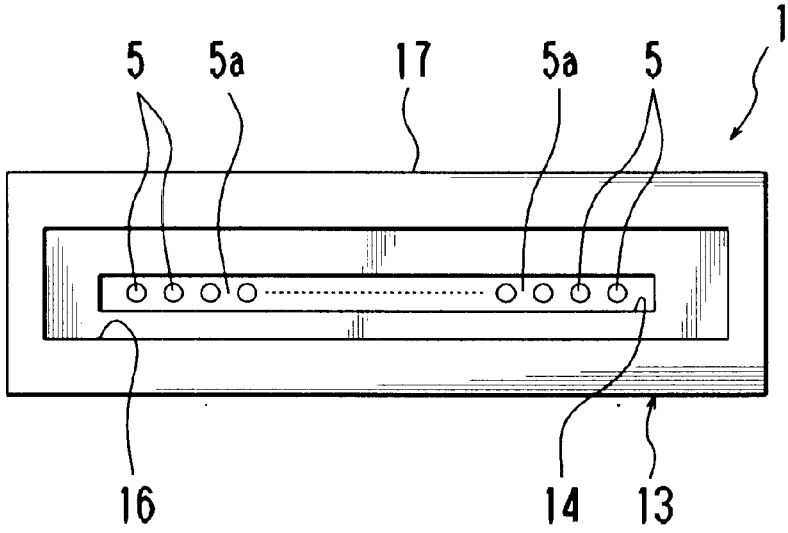
FIG. 1(A) is an elevation view of an ink jet printer head according to the first embodiment of the present invention.
Figure 1B:
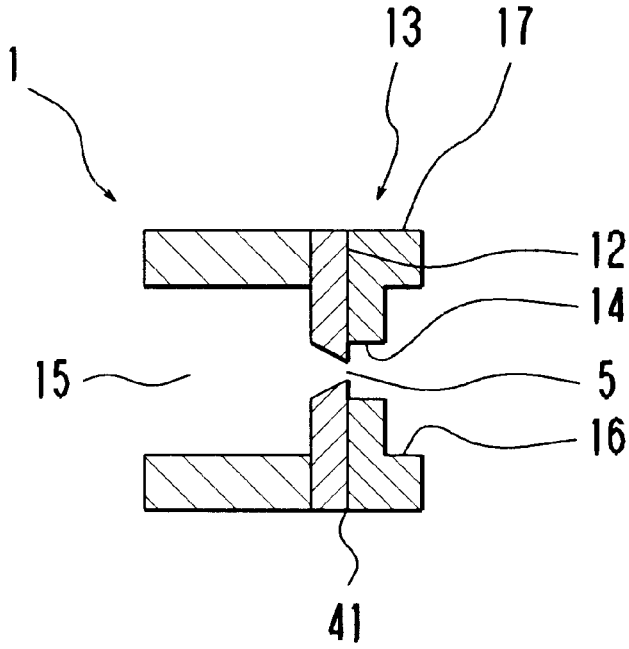
FIG. 1(B) is a longitudinal section view of a front end of the ink jet printer head according to the first embodiment of the present invention.
Figure 8:
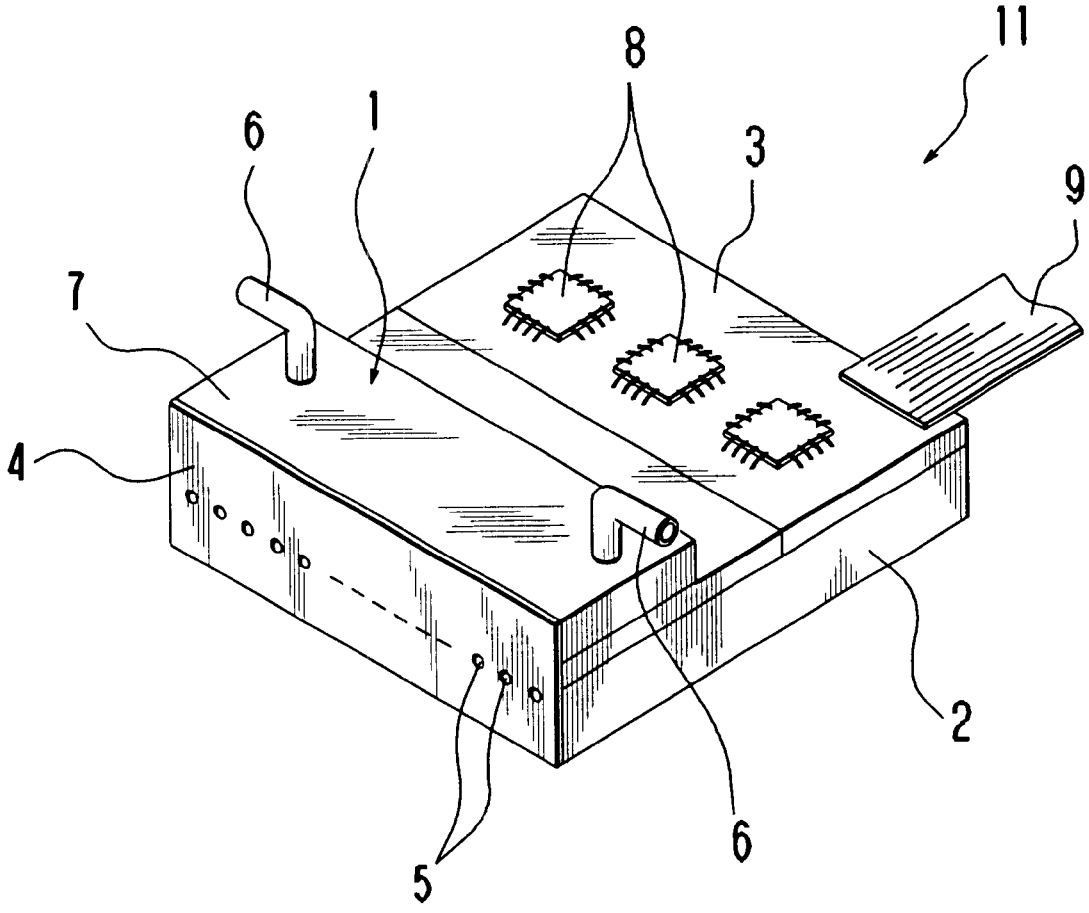
Fig. 8 RELATED ART
FIG. 8 is a perspective view of a conventional ink jet printer head unit.

FIG. 1(A) is an elevation view of an ink jet printer head according to the first embodiment of the present invention. FIG. 1(B) is a longitudinal section view of a front end of the ink jet printer head according to the first embodiment of the present invention. The same parts as those in FIG. 8 are designated by the same reference numerals, and are not again explained herein.

As shown in FIG. 1, the orifices 5, which operates ink nozzles connecting to the ink chamber 15 for jetting ink, are arrayed along long direction of the front surface 12 of the ink jet printer head 1 in the even pitch.

The ink jet printer head 1 provides a plate-like protect member 13 on the front surface 12. The protect member 13 provides a slit 14 at the center thereof so as to correspond to an array of the orifices 5. An orifice surface 5*a* provided on the front surface 12 of the ink jet printer head 1 is exposed through the slit 14. The plate-like protect member 13 having slit 14 causes the periphery of the orifices 5 higher than the orifice surface 5*a*, so that the orifices 5 and the orifice surface 5*a* are protected by the protect member 13.

The protect member 13 can be positioned to the ink jet printer head 1 using optical method or a guide provided on the protect member 13. Other method can be used for positioning the protect member 13 and the ink jet printer head 1. The protect member 13 can be fabricated from resin, metal or the like.

As mentioned above, the plate-like protect member 13 having slit 14 causes the periphery of the orifices 5 higher than the orifice surface 5*a*, so that the orifices 5 and the orifice surface 5*a* are protected by the protect member 13 from scrape, breakage or the like, when the wiping operation or the like was executed.

The protect member 13 provides a step 16 around the orifices 5 having an outer portion higher than an inner portion. The step 16 identifies a creep preventing structure and a move restraint member. The step 16 is arranged at almost center between a long end surface 17 of the protect member 13 and the slit 14. The thickness of the protect member 13 is determined, for instance, 0.1 mm–0.3 mm, the height of the step 16 is determined, for instance, 0.05 mm–0.1 mm.

The step 16 can prevent the attached ink on the surface of the protect member 13 moving, so that the step 16 prevents the jetted ink from the orifices 5 to creep up toward the back of the ink jet printer head 1 which is reverse direction to the ink jetting direction.

Figure 2A:
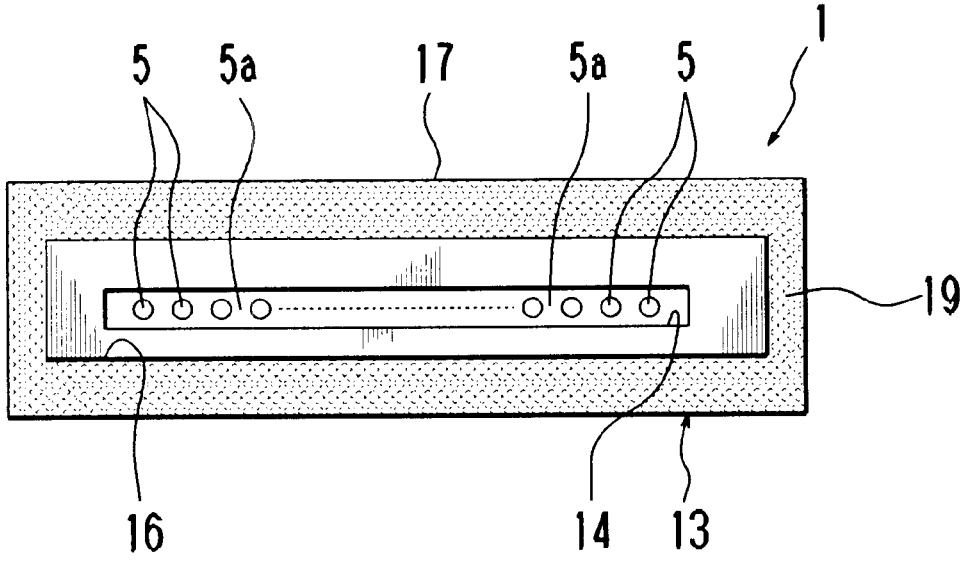
FIG. 2(A) is an elevation view of the ink jet printer head having an ink repellency layer according to the first embodiment of the present invention.
Figure 2B:
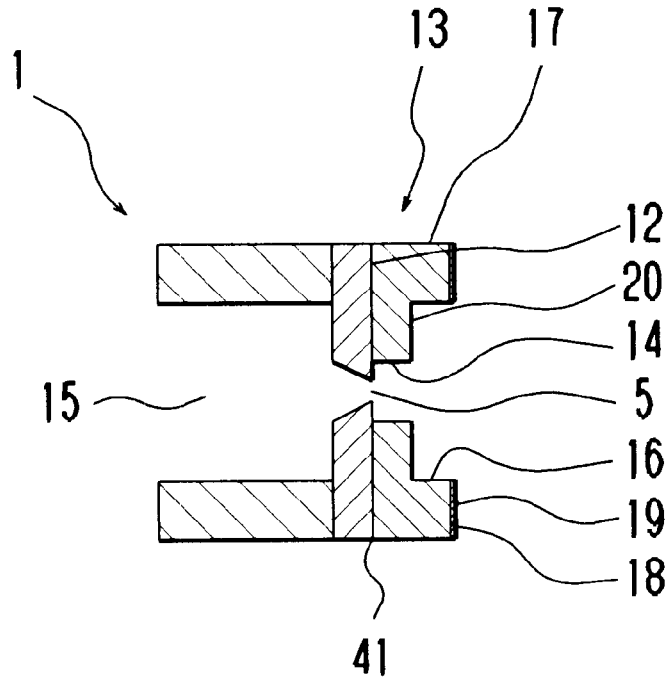
FIG. 2(B) is a longitudinal section view of the front end of the ink jet printer head illustrated in FIG. 2(A)

FIG. 2(A) is an elevation view of the ink jet printer head 1 having an ink repellency layer according to the first embodiment of the present invention. FIG. 2(B) is a longitudinal section view of the front end of the ink jet printer head 1 illustrated in FIG. 2(A). As shown in FIG. 2, an ink repellency layer 19 may be provided on the outer portion with respect to the front surface of the protect member 13, for instance, a surface 18 which is higher than the inner portion, by spreading the ink repellent material. The ink repellency layer 19 identifies the creep preventing structure and an attachment restraint member. The material of the ink repellency layer 19 may be selected from several materials. For instance, fluoropolymers like FEP may be coated on the protect member 13 using electro deposition for forming the ink repellency layer 19. It is desirable that the ink repellency of the present invention has contact angle to the ink more than 90 degree.

The ink repellency layer 19 can restrain the ink to attach to the surface of the protect member 13, so that the ink repellency layer 19 restrains the jetted ink from the orifices 5 to creep up toward the back of the ink jet printer head 1 which is reverse direction to the ink jetting direction.

The ink repellency layer 19 may be provided on the inner portion with respect to the front surface of the protect member 13, for instance, a surface 20 which is lower than the outer portion with respect to the front surface of the protect member 13, or both of the surface 18 and 20.

In case that the ink repellency layer 19 is provided on the outer portion with respect to the front surface of the protect member 13 like the surface 18, maintenance like wiping, ink absorbing or the like can be merely executed to the portion around the orifices 5 without touch to the ink repellency layer 19, so that the ink repellency layer 19 is protected from abrasion so as to be able to keep the effect for preventing the jetted ink from the orifices 5 of the ink jet printer head 1 to creep up toward the back of the ink jet printer head 1.

As other embodiment of the present invention, the protect member 13 itself may be fabricated from a material having ink repellency for obtaining the protect member 13 ink repellent.

In case forming the ink repellency layer 19 on the protect member 13 like present embodiment, the material having ink wetability can be used as the protect member 13.

A second embodiment of the present invention is now explained with reference to FIGS. 3(A), (B) and 4(A), (B). The same parts as those in the first embodiment are designated by the same reference numerals, and are not again explained herein.

Figure 3A:
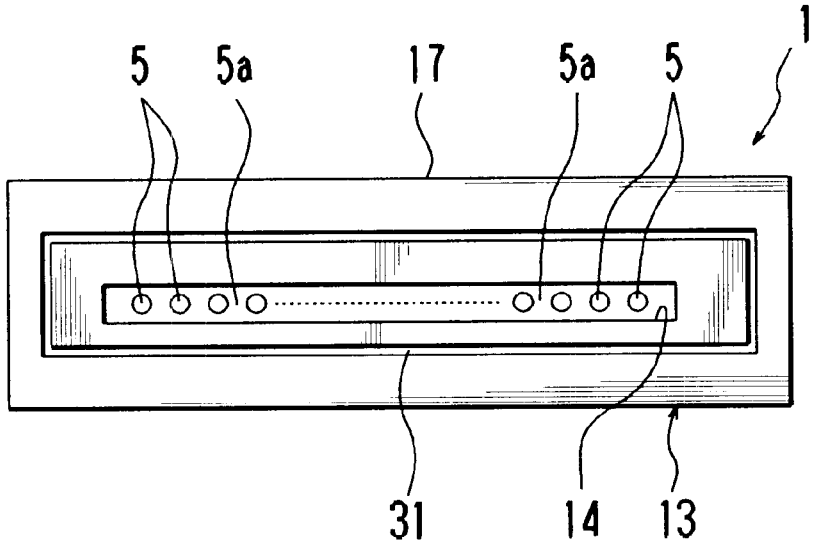
FIG. 3(A) is an elevation view of an ink jet printer head according to the second embodiment of the present invention.
Figure 3B:
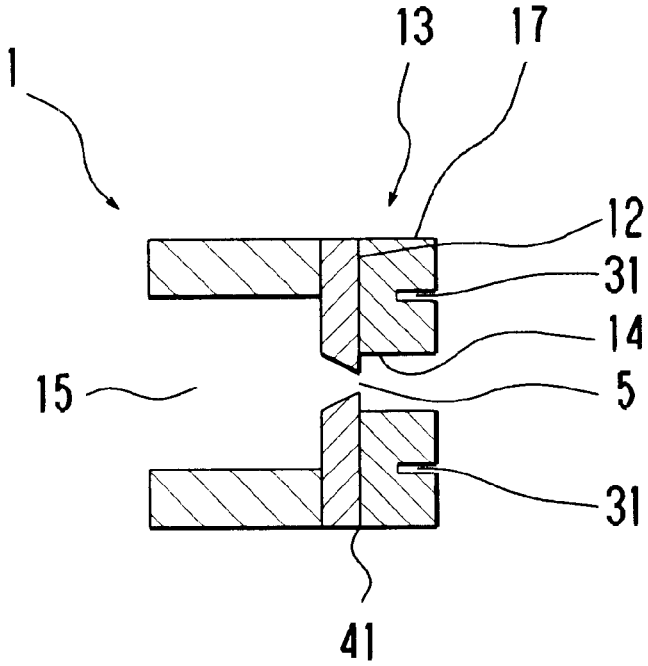
FIG. 3(B) is a longitudinal section view of a front end of the ink jet printer head according to the second embodiment of the present invention.

FIG. 3(A) is an elevation view of an ink jet printer head according to the second embodiment of the present invention. FIG. 3(B) is a longitudinal section view of a front end of the ink jet printer head according to the second embodiment of the present invention.

The second embodiment of the present invention is different to the first embodiment of the present invention with respect to the move restraint member as the creep preventing structure. That is, a groove 31 is provided on the front surface of the protect member 13 around the orifices 5 instead of the step 16. The thickness of the protect member 13 is determined, for instance, 0.1 mm–0.3 mm, the depth of the groove 31 is determined, for instance, 0.05 mm–0.1 mm.

The groove 31 can prevent the attached ink on the surface of the protect member 13 moving, so that the step 16 prevents the jetted ink from the orifices 5 to creep up toward the back of the ink jet printer head 1 which is reverse direction to the ink jetting direction.

Figure 4A:
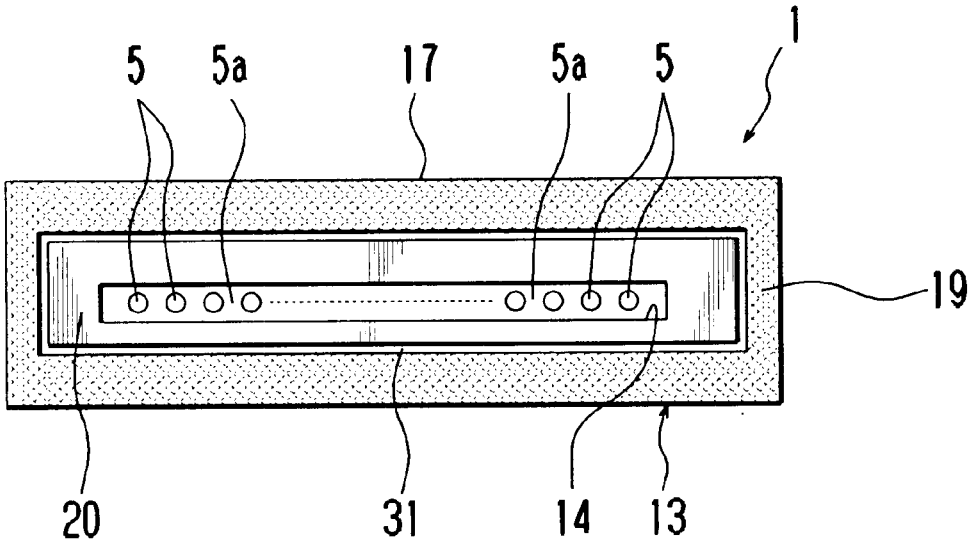
FIG. 4(A) is an elevation view of the ink jet printer head having an ink repellency layer according to the second embodiment of the present invention.
Figure 4B:
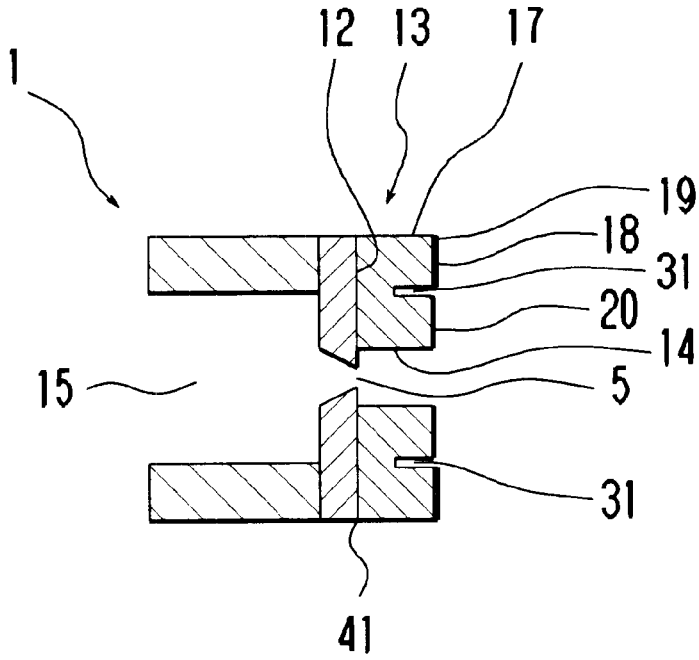
FIG. 4(B) is a longitudinal section view of the front end of the ink jet printer head illustrated in FIG. 4(A)

FIG. 4(A) is an elevation view of the ink jet printer head 1 having the ink repellency layer 19 according to the second embodiment of the present invention. FIG. 4(B) is a longitudinal section view of the front end of the ink jet printer head 1 illustrated in FIG. 4(A). As shown in FIG. 4, the ink repellency layer 19 may be provided on the outer portion with respect to the front surface of the protect member 13, for instance, a surface 18. The ink repellency layer 19 identifies the creep preventing structure and an attachment restraint member.

The ink repellency layer 19 can restrain the ink to attach to the surface of the protect member 13, so that the ink repellency layer 19 restrains the jetted ink from the orifices 5 to creep up toward the back of the ink jet printer head 1 which is reverse direction to the ink jetting direction.

The ink repellency layer 19 may be provided on the inner portion with respect to the front surface of the protect member 13, for instance, a surface 20 or both of the surface 18 and 20.

As other embodiment of the present invention, the protect member 13 itself may be fabricated from a material having ink repellency for obtaining the protect member 13 ink repellent.

As other embodiment of the first and second embodiment of the present invention, only ink repellency layer 19 can be provided on the protect member 13 without providing the step 16 or the groove 31 in order to restrain the jetted ink from the orifices 5 to creep up toward the back of the ink jet printer head 1.

On the contrast, both of the step 16 and the ink repellency layer 19, or both of the groove 31 and the ink repellency layer 19 are provided on the protect member 13 without providing the step 16 or the groove 31 in order to restrain the jetted ink from the orifices 5 to creep up toward the back of the ink jet printer head 1, in the first or second embodiment of the invention. These structures of the first and second embodiment generate synergism with respect to ink restraint, so that the structures restrain the jetted ink from the orifices 5 to creep up toward the back of the ink jet printer head 1 strongly.

It is desirable to caulk the connecting portion 41 (refer FIGS. 1–4) of the front surface of the ink jet printer head 1 and the protect member 13 with a filler (not shown) like adhesive. The filler is able to prevent the ink to creep up from a gap between the front surface of the ink jet printer head 1 and the protect member 13.

It is also desirable to form a recess in the connecting portion 41 so as to allow the escaped adhesive enclosing. The recess is able to prevent the adhesive following out and creeping up toward the protect member 13 and the front surface of the ink jet printer head 1.

A third embodiment of the present invention is now explained with reference to FIGS. 5(A), (B), (C) and 6. The same parts as those in the first embodiment are designated by the same reference numerals, and are not again explained herein.

Figure 5A:
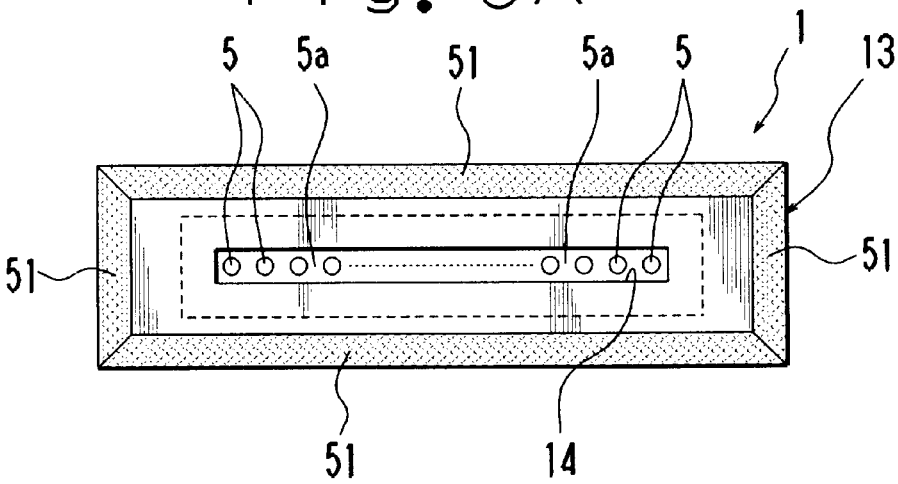
FIG. 5(A) is an elevation view of the ink jet printer head according to the third embodiment of the present invention.
Figure 5B:
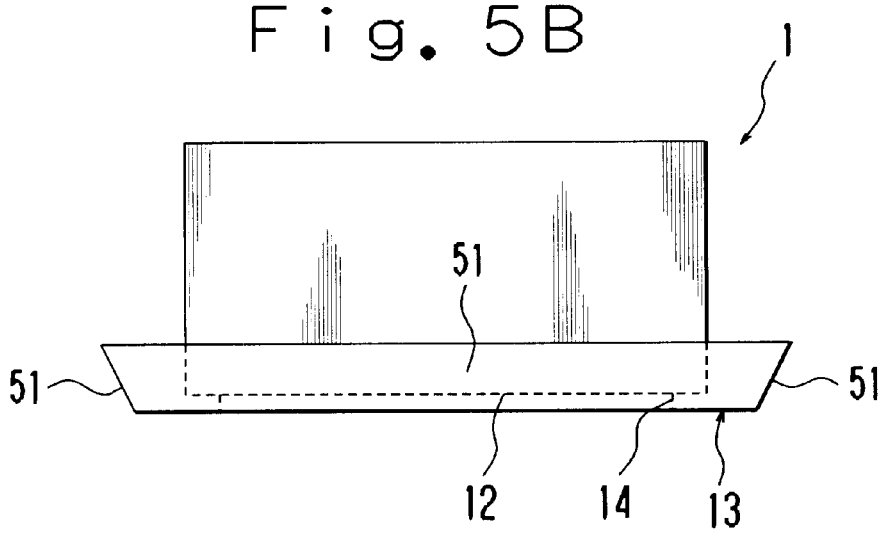
FIG. 5(B) is a plan view of the ink jet printer head according to the third embodiment of the present invention.
Figure 5C:
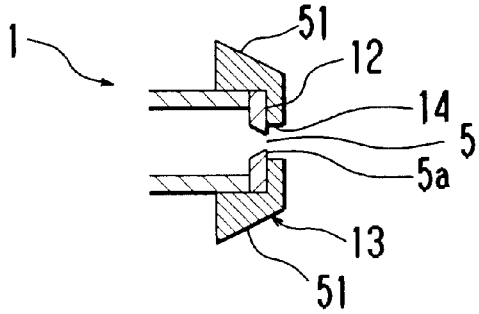
FIG. 5(C) is a longitudinal section view of a front end of the ink jet printer head according to the third embodiment of the present invention.

FIG. 5(A) is an elevation view of the ink jet printer head 1 according to the third embodiment of the present invention. FIG. 5(B) is a plan view of the ink jet printer head 1 according to the third embodiment of the present invention. FIG. 5(C) is a longitudinal section view of a front end of the ink jet printer head 1 according to the third embodiment of the present invention.

As shown in FIG. 5, the orifices 5, which operates the ink nozzles jetting the ink, are arrayed on the front surface 12 of the ink jet printer head 1 with even pitch along longer direction of the front surface 12.

The ink jet printer head 1 provides the plate-like protect member 13 on the front surface 12. The protect member 13 provides the slit 14 at the center thereof so as to correspond to the array of the orifices 5. The orifice surface 5*a* provided on the front surface 12 of the ink jet printer head 1 is exposed through the slit 14. The plate-like protect member 13 having slit 14 causes the periphery of the orifices 5 higher than the orifice surface 5*a*, so that the orifices 5 and the orifice surface 5*a* are protected by the protect member 13.

As mentioned above, the plate-like protect member 13 having slit 14 causes the periphery of the orifices 5 higher than the orifice surface 5*a*, so that the orifices 5 and the orifice surface 5*a* are protected by the protect member 13 from scrape, breakage or the like, when the wiping operation or the like was executed.

The protect member 13 has a shape, the periphery of the end 51 of which is tapered toward the front end of the ink jet printer head 1. The tapered shape of the protect member 13 identifies the creep preventing structure and a move restraint member.

The tapered shape of the protect member 13 is able to prevent the ink to creep up toward the back of the ink jet printer head 1.

As same to the first and second embodiment, a surface with respect to the end 51 of the protect member 13 may be covered by the ink repellency layer (not shown in FIGS. 5(A), (B), (C)) in order to cause the surface of the end 51 ink repellent. The ink repellency layer identifies the creep preventing structure and an attachment restraint member. It is desirable that the ink repellency of the present invention has contact angle to the ink more than 90 degree.

As mentioned above, the surface with respect to the end 51 of the protect member 13 is covered by the ink repellency layer, so that the portion of the protect member 13 having ink repellent repels the ink crept up from the orifices 5 toward certain direction, so that it is possible to prevent the ink to creep up toward the back of the ink jet printer head 1.

Figure 6:
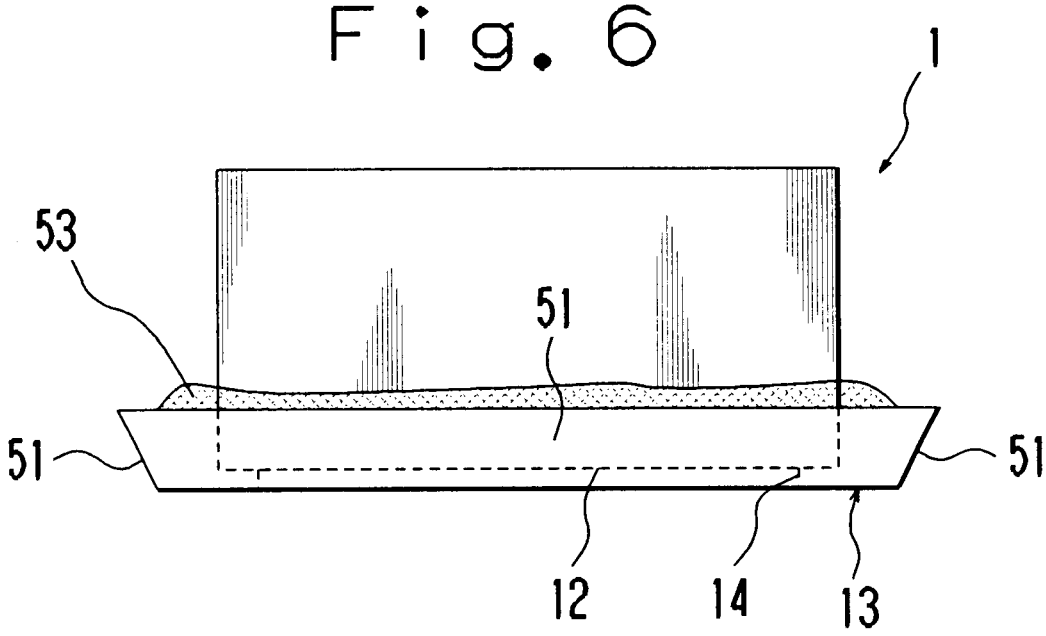
FIG. 6 is a plan view of the ink jet printer head according to the third embodiment of the present invention.

Further more, the connecting portion of the front end of the ink jet printer head 1 and the protect member 13 is caulked by the filler 53 like adhesive (refer FIG. 6). Thus, the filler 53 is able to prevent the ink to escape from the gap of the connecting portion of the front surface of the ink jet printer head 1 and the protect member 13.

A fourth embodiment of the present invention is now explained with reference to FIGS. 5(A), (B), (C). The same parts as those in the third embodiment are designated by the same reference numerals, and are not again explained herein.

Figure 7A:
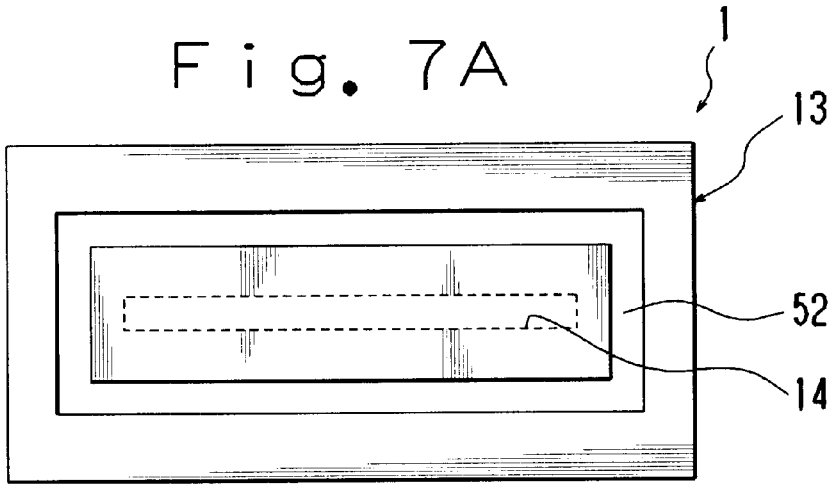
FIG. 7(A) is a rear elevation view of the ink jet printer head according to the fourth embodiment of the present invention.
Figure 7B:
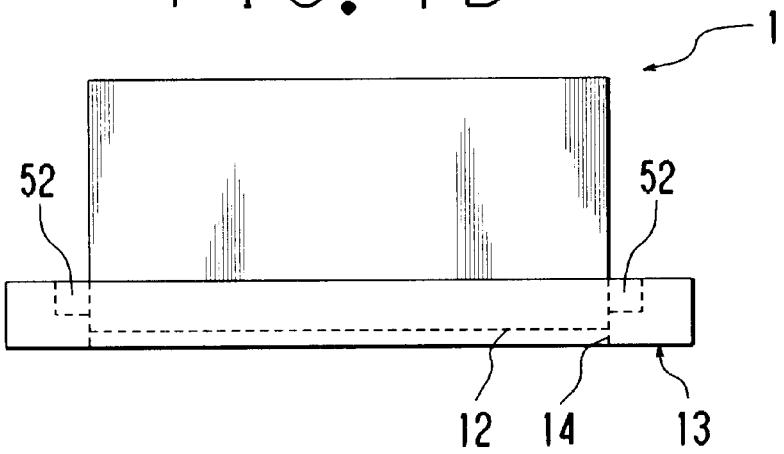
FIG. 7(B) is a plan view of the ink jet printer head according to the fourth embodiment of the present invention.
Figure 7C:
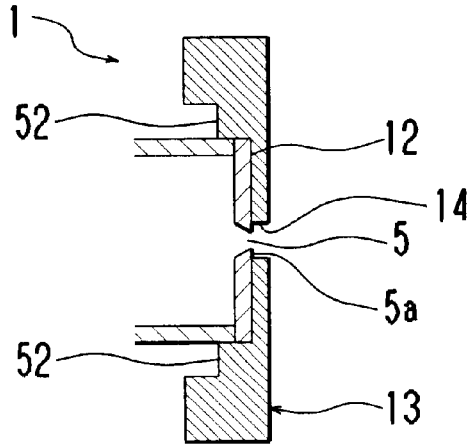
FIG. 7(C) is a longitudinal section view of a front end of the ink jet printer head according to the fourth embodiment of the present invention.

FIG. 7(A) is a rear elevation view of the ink jet printer head according to the fourth embodiment of the present invention. FIG. 7(B) is a plan view of the ink jet printer head according to the fourth embodiment of the present invention. FIG. 7(C) is a longitudinal section view of a front end of the ink jet printer head according to the fourth embodiment of the present invention.

The fourth embodiment of the present invention is different to the third embodiment of the present invention with respect to:

the protect member 13 is adhered to the front surface of the ink jet printer head 1 by the adhesive; and a recess 52 is provided in the connecting portion of the front surface of the ink jet printer head 1 and the protect member 13 so as to prevent the adhesive to leak and flow toward the protect member 13 or the front end of the ink jet printer head 1.

Thus, the ink jet printer head 1 is able to escape the excessive adhesive to the recess 52, so that the recess 52 is able to prevent the adhesive to leak out and flow toward the protect member 13 or the front end of the ink jet printer head 1.

In the above mentioned first, second, third and fourth embodiment of the present invention, the a protect member 13 is attached to the front surface of the ink jet printer head 1 to cause periphery of the orifices 5 higher than the orifice surface 5*a* so as to protect the orifice surface 5*a*. As other embodiment, a step may be provided on the front surface 12 (same to the orifice surface 5*a*) in order to cause periphery of the orifices 5 higher than the orifice surface 5*a*.

As other embodiment of the present invention, the structures of the each embodiment may be combined in appropriate.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet printer head, comprising:

an ink chamber for storing ink;

a plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a plate-like protect member provided on the front surface of the ink jet printer head to cause at least both sides of the ink nozzle array to be higher than an ink nozzle arranging surface so as to protect the ink nozzle arranging surface, the protect member having a slit for exposing the ink nozzles, wherein the creep preventing structure is formed as a move restraint member for preventing the attached ink on the front surface of the ink jet printer head to move toward the back of the ink jet printer head, wherein the move restraint member is formed at a front surface of the protect member, the move restraint member is formed as a groove around the ink nozzle array or a step around the ink nozzle array having an outer portion higher than an inner portion, and wherein the slit includes a wall arranged around the ink nozzles a predetermined distance from the ink nozzles.

2. An ink jet printer head according to claim 1, wherein the creep preventing structure further includes an attachment restraint member for restraining the ink to attach to the front surface of the ink jet printer head.

3. An ink jet printer head according to claim 2, wherein the attachment restraint member has a surface to be ink repellent at a portion in which the ink is capable of creeping up toward the back of the ink jet printer head.

4. An ink jet printer head according to claim 3, wherein a filler is caulked in a connecting portion of the protect member and the front end of the ink jet printer head.

5. An ink jet printer head according to claim 1, wherein the creep preventing structure further includes an attachment restraint member for restraining the ink to attach to the front surface of the ink jet printer head.

6. An ink jet printer head according to claim 4, wherein the attachment restraint member is formed at a front surface of the protect member by causing at least part of the front surface of the protect member to be ink repellent.

7. An ink jet printer head according to claim 4, wherein the attachment restraint member is formed at the front surface of the protect member by causing at least part of the front surface of the protect member ink repellent.

8. An ink jet printer head according to claim 7, wherein an outer portion of the groove or the step causes ink repellent.

9. An ink jet printer head according to claim 1, wherein the protect member has a shape, which is tapered toward the front end of the ink jet printer head, as the move restraint member.

10. An ink jet printer head according to claim 9, wherein a filler is caulked in a connecting portion of the protect member and the front end of the ink jet printer head.

11. An ink jet printer head, comprising:

an ink chamber for storing ink;

a plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a protect member provided on the front surface of the ink jet printer head to cause at least both sides of the ink nozzle array to be higher than an ink nozzle arranging surface so as to protect the ink nozzle arranging surface, wherein the creep preventing structure is formed as a move restraint member for preventing the attached ink on the front surface of the ink jet printer head to move toward the back of the ink jet printer head, wherein the move restraint member is formed at a front surface of the protect member, the move restraint member is formed as a groove around the ink nozzle array or a step around the ink nozzle array having an outer portion higher than an inner portion, and wherein the protect member is adhered to the front end of the ink jet printer head by adhesive, and a connecting portion of the protect member and the front end of the ink jet printer head provides a recess so as to allow the escaped adhesive enclosing.

12. An ink jet printer head, comprising:

an ink chamber for storing ink;

a plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a protect member provided on the front surface of the ink jet printer head to cause at least both sides of the ink nozzle array to be higher than an ink nozzle arranging surface so as to protect the ink nozzle arranging surface, wherein the creep preventing structure is formed as a move restraint member for preventing the attached ink on the front surface of the ink jet printer head to move toward the back of the ink jet printer head, wherein the move restraint member is formed at a front surface of the protect member by causing at least part of the front surface of the protect member ink repellent, and wherein the protect member is adhered to the front end of the ink jet printer head by adhesive, and a connecting portion of the protect member and the front end of the ink jet printer head provides a recess so as to allow the escaped adhesive enclosing.

13. An ink jet printer head, comprising:

an ink chamber for storing ink;

plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a protect member provided on the front surface of the ink jet printer head to cause at least both sides of the ink nozzle array to be higher than an ink nozzle arranging surface so as to protect the ink nozzle arranging surface, wherein the creep preventing structure is formed as a move restraint member for preventing the attached ink on the front surface of the ink jet printer head to move toward the back of the ink jet printer head and an attachment restraint member for restraining the ink to attach to the front surface of the ink jet printer head, wherein the move restraint member is formed at a front surface of the protect member, the move restraint member is formed as a groove around the ink nozzle array or a step around the ink nozzle array having an outer portion higher than an inner portion, wherein the attachment restraint member is formed at the front surface of the protect member by causing at least part of the front surface of the protect member ink repellent, and wherein the protect member is adhered to the front end of the ink jet printer head by adhesive, and a connecting portion of the protect member and the front end of the ink jet printer head provides a recess so as to allow the escaped adhesive enclosing.

14. An ink jet printer head, comprising:

an ink chamber for storing ink;

a plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a protect member provided on the front surface of the ink jet printer head to cause at least both sides of the ink nozzle array to be higher than an ink nozzle arranging surface so as to protect the ink nozzle arranging surface, wherein the creep preventing structure is formed as a move restraint member for preventing the attached ink on the front surface of the ink jet printer head to move toward the back of the ink jet printer head and an attachment restraint member for restraining the ink to attach to the front surface of the ink jet printer head, wherein the move restraint member is formed at a front surface of the protect member, the move restraint member is formed as a groove around the ink nozzle array or a step around the ink nozzle array having an outer portion higher than an inner portion, wherein the attachment restraint member is formed at the front surface of the protect member by causing at least part of the front surface of the protect member ink repellent, wherein the outer portion of the groove or the step causes ink repellent, and wherein the protect member is adhered to the front end of the ink jet printer head by adhesive, and a connecting portion of the protect member and the front end of the ink jet printer head provides a recess so as to allow the escaped adhesive enclosing.

15. An ink jet printer head, comprising:

an ink chamber for storing ink;

a plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a protect member provided on the front surface of the ink jet printer head to cause at least both sides of the ink nozzle array to be higher than an ink nozzle arranging surface so as to protect the ink nozzle arranging surface, wherein the creep preventing structure is formed as a move restraint member for preventing the attached ink on the front surface of the ink jet printer head to move toward the back of the ink jet printer head, wherein the protect member has a shape, which is tapered toward the front end of the ink jet printer head, as the move restraint member, and wherein the protect member is adhered to the front end of the ink jet printer head by adhesive, and a connecting portion of the protect member and the front end of the ink jet printer head provides a recess so as to allow the escaped adhesive enclosing.

16. An ink jet printer head, comprising:

an ink chamber for storing ink;

a plurality of ink nozzles arrayed at a front surface of the ink jet printer head to connect to the ink chamber so as to contribute jetting the ink; and a creep preventing structure provided adjacent to the ink nozzles for preventing the jetted ink from the ink nozzle to creep up toward a back of the ink jet printer head which is reverse direction to the ink jetting direction, wherein the creep preventing structure is formed as an attachment restraint member for restraining the ink to attach to the front surface of the ink jet printer head, wherein the attachment restraint member has a surface to be ink repellent at a portion in which the ink is capable of creeping up toward the back of the ink jet printer head, and wherein the protect member is adhered to the front end of the ink jet printer head by adhesive, and a connecting portion of the protect member and the front end of the ink jet printer head provides a recess so as to allow the escaped adhesive enclosing.

17. An ink jet printer head, comprising:

an ink chamber for storing ink;

a plurality of ink nozzles arrayed at a front surface of the ink jet printer head to connect to the ink chamber so as to contribute jetting the ink;

a creep preventing structure provided adjacent to the ink nozzles for preventing the jetted ink from the ink nozzle to creep up toward a back of the ink jet printer head which is reverse direction to the ink jetting direction; and a protect member provided on the front surface of the ink jet printer head to cause at least both sides of the ink nozzle array to be higher than an ink nozzle arranging surface so as to protect the ink nozzle arranging surface, wherein the creep preventing structure is formed as a move restraint member for preventing the attached ink on the front surface of the ink jet printer head to move toward the back of the ink jet printer head, wherein the protect member has a shape, which is tapered toward the front end of the ink jet printer head, as the move restraint member, wherein a filler is caulked in a connecting portion of the protect member and the front end of the ink jet printer head, and wherein the protect member is adhered to the front end of the ink jet printer head by adhesive, and a connecting portion of the protect member and the front end of the ink jet printer head provides a recess so as to allow the escaped adhesive enclosing.

* * * * *